US005253440A

United States Patent [19]

Chang

[11] Patent Number: 5,253,440

[45] Date of Patent: Oct. 19, 1993

[54] STRUCTURE OF A PICTURE FRAME

[76] Inventor: Thomas Chang, Suite 1, 11F, 95-8 Chang Ping Road, Sec. 1, Taichung, Taiwan

[21] Appl. No.: 944,392

[22] Filed: Sep. 14, 1992

[51] Int. Cl.[5] ..... G09F 1/12

[52] U.S. Cl. ..... 40/152.1; 40/158.1

[58] Field of Search ..... 292/145, DIG. 38; 40/152, 152.1, 156, 158.1, 611

[56] References Cited

U.S. PATENT DOCUMENTS

| | | | |
|---|---|---|---|
| 681,703 | 9/1901 | Jacobson | 40/152 |
| 1,517,447 | 12/1924 | Merz | 292/145 |
| 1,702,263 | 2/1929 | L'Enfant | 40/152 |
| 1,842,473 | 1/1932 | Glassner | 40/152 |
| 1,851,492 | 3/1932 | Budd | 40/152 |

FOREIGN PATENT DOCUMENTS

| | | | |
|---|---|---|---|
| 2114884 | 9/1983 | United Kingdom | 40/152 |

*Primary Examiner*—Kenneth J. Dorner
*Assistant Examiner*—J. Bonifanti

[57] ABSTRACT

A picture frame comprises a molded frame member having a generally planar rear surface, a rectangular rear backing plate, and an elongate support. A generally rectangular housing recess on the rear surface defines an inner land, the inner periphery of which circumscribes the window aperture of the picture frame. Opposing peripheral walls in the recess adjoining the land have respective elongate grooves formed therein for receiving a protruding fin on a first longitudinal edge of the backing plate. A slide aperture is formed centrally on the backing plate adjacent a second longitudinal edge including a recess on the front surface of the plate in communication therewith and extending to the proximate edge. A sliding catch positioned therein is engageable with a second groove of the housing recess to releasably secure the plate to the frame member. Two further apertures formed on a central portion of the backing plate are traversed by axis rods which protrude rearwards therefrom. A first end portion of the support has transversely disposed resilient sockets engaged with respective axis rods of the backing plate to hingedly attach the support therewith.

1 Claim, 3 Drawing Sheets

STRUCTURE OF A PICTURE FRAME

BACKGROUND OF THE PRESENT INVENTION

The present invention relates to picture frames for use with photos and the like, and more particularly to a picture frame of simplified assembly and manufacture.

Referring to FIG. 1 of the drawings, a conventional structure picture frame comprises a rectangular outer frame member 1, a rectangular rear retaining frame 2 adhesively adjoined therewith, a rectangular backing plate 3 with a support plate 4 hingedly attached to the rear thereof. Both the outer frame and retaining frame are provided with rectangular inner peripheries that define apertures 1*a*, 2*a* that house respectively a window cover and portrait or photo print. Once the latter are in place, the backing plate 3 which has equivalent dimensions can be positioned flush with aperture 2*a* of the retaining frame. Swivel plates 5 around the inner periphery of frame 2 can then be rotated so as to be in contact with the rear of plate 3 to secure the backing thereon. The support plate 4 is hingedly attached to plate 3 via cooperating hinge elements 6 provided on the respective members.

As is apparent, several different members that are separately manufactured from differing materials must be assembled during the production of the picture frame, wherein retaining frame 2 and backing plate 3 are usually formed from die-cut sheet material, the swivel plates and hinge elements are of pressed metal attached with rivets, and the outer frame of a molded plastic. Whereas, the picture frame of the present invention provides a structure whose members are manufactured from injection molding processes and which can be quickly assembled without need of further fasteners or adhesives, so as to facilitate production and reduce costs.

SUMMARY OF THE PRESENT INVENTION

A picture frame in accordance with the present invention comprises an injection molded frame member having a generally planar rear surface, a similarly formed rectangular backing plate, and a support hingedly attached to the rear of the backing plate. A rectangular recess of substantially the same dimensions as the backing plate is formed on the rear surface for housing a window cover and print, wherein the recess defines an inner land circumscribing a central viewing aperture. A fin protruding from a first longitudinal edge of the backing engages a corresponding groove in a peripheral wall of the recess when the backing is positioned therein. The backing is releasably secured over the rear of the recess by a sliding catch adjacent the second longitudinal edge of the backing which is engageable with a similar groove on an opposing peripheral wall of the recess. A pair of axis rods traversing respective apertures on a central portion of the backing are offset so as to protrude from the rear surface thereof. The support has a pair of lateral members extending from an end portion thereof that carry resilient sockets which snap engage with respective axis rods on the backing plate to hingedly attach the support to the rear of the picture frame.

It is a main object of the present invention to provide a picture frame of improved characteristic which facilitates rapid manufacture and assembly of its component members.

For a more thorough understanding of the present invention reference should be made to a detailed description of a preferred embodiment thereof, provided below along with accompanying drawings.

DETAILED DESCRIPTION OF THE PREFERRED EMBODIMENT

Figure 1:
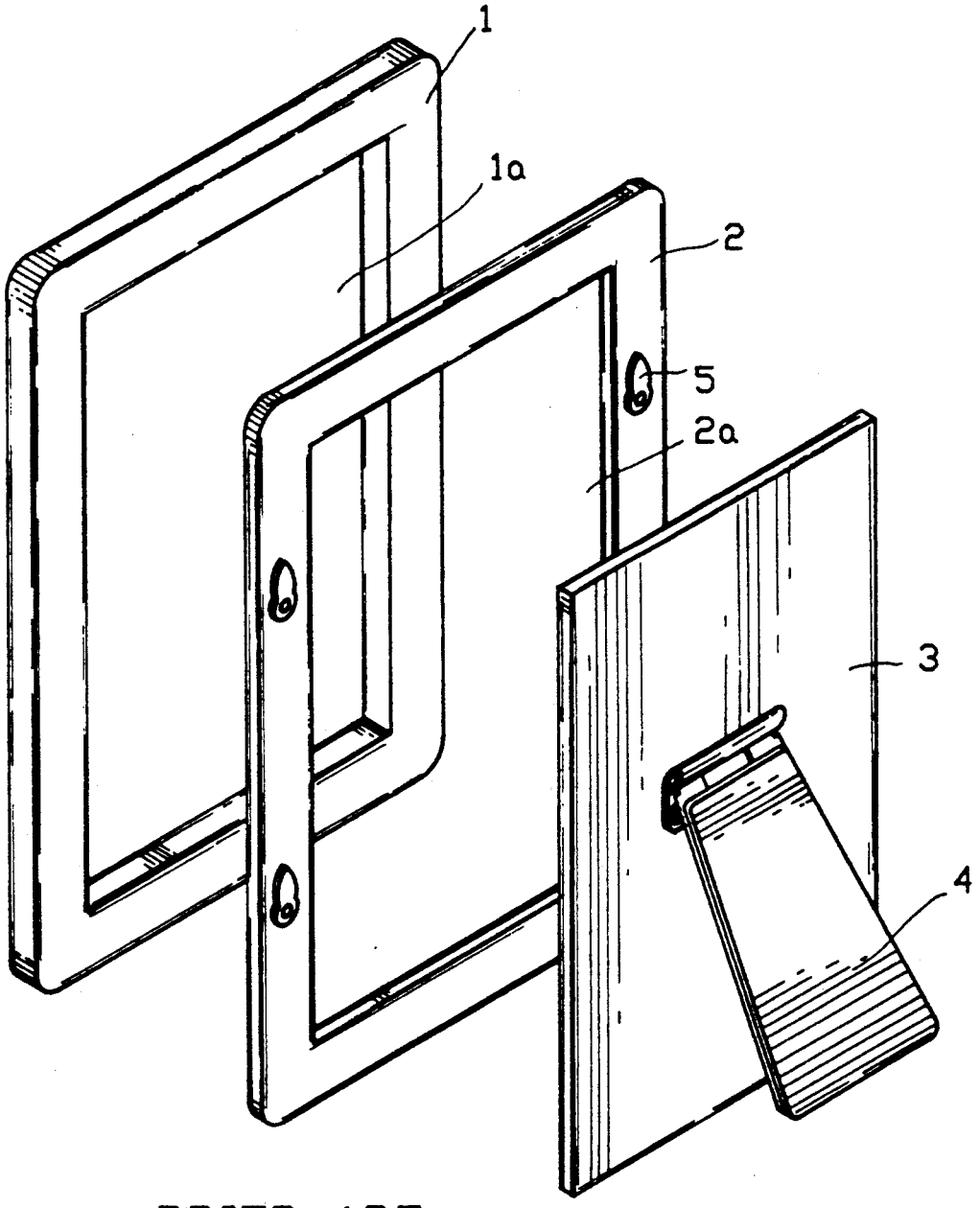
PRIOR ART FIG 1
FIG. 1 is a perspective view showing a picture frame structure of the prior art.
Figure 2:
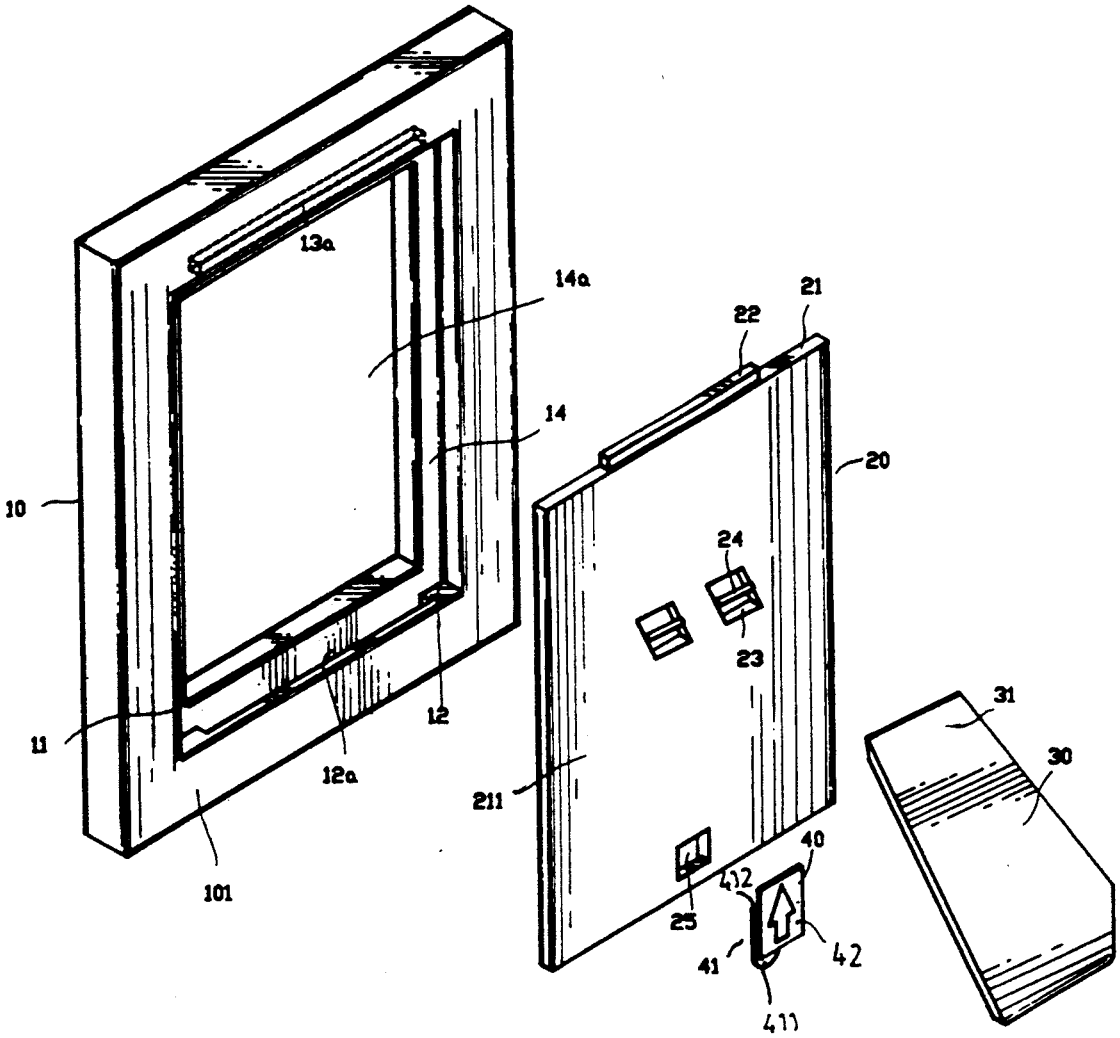
FIG. 2 is a perspective view of the picture frame of the present invention.
Figure 3:
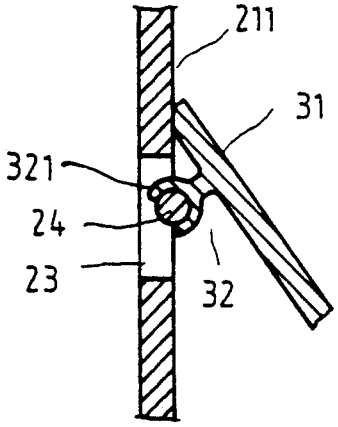
FIG. 3 is a sectional view of a slide catch on a backing plate of the picture frame.

Referring to FIG. 2 of the drawings a preferred embodiment of the picture frame comprises an injection molded frame member 10, a similarly formed rectangular backing plate 20, and an elongate plate like support 30.

A generally rectangular recess 11 on the planar rear surface 101 of the frame member defines an inner step or land 14 surrounded by adjacent longitudinal peripheral walls 12 and lateral peripheral walls. A rectangular inner periphery of land 14 circumscribes a central opening 14*a* which defines the viewing aperture of the picture frame. Each longitudinal peripheral wall in recess 11 has a respective elongate groove 12*a*, 13*a* formed centrally therein.

Figure 4:
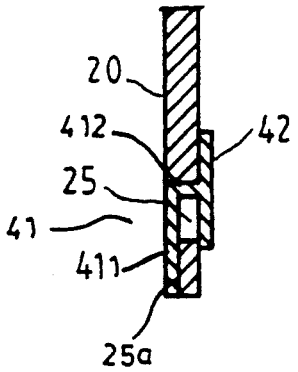
FIG. 4 is a sectional view of a hinged connection between the backing plate and a support plate.

Backing plate 20 has rectangular dimensions nearly equal with those of recess 11 and a predetermined thickness which is less than the depth thereof. An elongate fin 22 extending centrally along a first longitudinal edge of the backing plate is parallel with and spaced from the plane of rear surface 211 thereon. A rectangular slide aperture 25 is formed centrally between the lateral sides of the backing plate in proximity to a second longitudinal edge. An elongate recess 25*a*, as shown in FIG. 4, on the front side of plate 20 extends from aperture 25 to the proximate edge thereon. A resilient sliding catch 40 is disposed within aperture 25, wherein a depending arm 411 of a generally L-shaped bolt member 41 of the catch is slidingly retained within recess 25*a*. A short cross element of member 412 extends through the aperture and adjoins the upper end of the depending arm 411 with a slide plate 42 riding on the front surface of the backing plate.

A pair of aligned rectangular apertures 23 are further provided on a central portion of the locking plate, with each aperture 23 being traversed by a cylindrical rod 24 crossing a central portion thereof. Each rod 24 is offset so as to protrude from rear surface 211 of the backing plate. As shown in FIG. 4, an upper end portion 31 of support 30 has a pair of lateral members 32 that protrude perpendicularly from a first side thereof. Each lateral member has a resilient socket 321 of roughly C-shaped section on the terminal end thereof which snap fits over a respective rod 24 to hingedly connect the support to the backing plate. Lateral members 32 are spaced from the beveled terminal edge of 31 which abuts the rear surface of plate 20 to limit the maximum angular separation of the support therewith.

A transparent window and photo print (not shown) are positioned within recess 11 prior to securement of backing cover 20 therein. Wherein, fin 22 is first inserted into a selected groove 12*a* or 13*a* and subsequently catch 40 is slid towards the proximate edge of the backing cover, so as to insert the depending arm of bolt 41 into the opposing groove in the frame member.

All members of the picture frame are produced largely automatically by injection molding machines and can be rapidly hand assembled without need of extraneous tools or fastening means. Further, the frame member can be made in a variety of art designs by retooling only a single mold member, as the mating mold member which defines the flat rear surface and housing recess is a set component adapted for receiving a standard size of photographic print. Tooling costs for manufacturing a variety of art designs would thus also be commensurately reduced.

The foregoing description should not be construed in a limitative sense but rather as being exemplary of the concepts embodied by the present invention, with the actual spirit and scope thereof being determined by the appended claims and their legal equivalents.

I claim:

1. A picture frame, comprising:

an injection molded frame member having a generally planar rear surface with a rectangular recess of predetermined dimensions formed thereon for housing a transparent window cover and print, said rectangular recess defining an inner land and surrounding lateral and longitudinal peripheral walls, the land having an inner peripheral edge circumscribing a viewing aperture of said picture frame, and each longitudinal peripheral wall having a groove formed therein;

an injection molded rectangular backing plate of predetermined thickness and similar rectangular dimensions with said rectangular recess, said backing plate having a projecting fin on a first longitudinal edge thereof parallel with and spaced from a rear surface of said backing plate, a slide aperture proximate a second longitudinal edge of said backing plate including an elongated recess on a front side of said backing plate extending from the second longitudinal edge thereof to the slide aperture, and at least a rectangular aperture on a central portion of said backing plate having a transverse axis rod offset so as to protrude from the rear surface of said backing plate;

an injection molded elongate support having at least a lateral member extending from a first side of a first end portion thereof and being spaced from a terminal edge on the first end portion, each lateral member having a resilient socket of C-shaped section on the terminal end thereof snap engaged with said corresponding axis rod on said backing plate to hingedly attach said support therewith, wherein the terminal edge of said support abuts the rear surface of said backing plate to limit the maximum angle of separation therebetween; and a resilient catch member slidingly disposed in said slide aperture having a slide plate riding on the rear surface of said backing plate, and a L-shaped bolt element which has a depending arm slidingly retained in said elongated recess of said slide aperture and a cross element adjoining said depending arm with said slide plate through said slide aperture, wherein said backing plate is releasably secured in said rectangular recess by inserting said fin thereon into one of said grooves in said rectangular recess and subsequently manipulating said slide plate of said catch member so as to engage said depending arm thereon with the other opposing groove in said rectangular recess.

* * * * *